US006634732B2

(12) United States Patent
Farr et al.

(10) Patent No.: US 6,634,732 B2
(45) Date of Patent: Oct. 21, 2003

(54) THERMOPLASTIC POLYMER FILM SEALING OF NOZZLES ON FLUID EJECTION DEVICES AND METHOD

(75) Inventors: Isaac Farr, Corvallis, OR (US); Steven N. Miller, Albany, OR (US); Steve H. Zhang, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 9 days.

(21) Appl. No.: 09/952,369

(22) Filed: Sep. 11, 2001

(65) Prior Publication Data

US 2003/0052939 A1 Mar. 20, 2003

(51) Int. Cl.[7] ..... B46J 2/165
(52) U.S. Cl. ..... 347/29
(58) Field of Search ..... 347/29, 22, 44, 347/85, 87, 106, 47, 50; 205/69; 216/27; 206/813; 428/343; 292/307 R; 525/123

(56) References Cited

U.S. PATENT DOCUMENTS 5,400,060 A * 3/1995 Carlotta ..... 347/29
5,414,454 A 5/1995 Reid ..... 347/29
5,424,768 A 6/1995 Dudek et al. ..... 347/29
5,850,238 A * 12/1998 Karita et al. ..... 347/29
5,917,514 A 6/1999 Higuma et al. ..... 347/29
6,102,518 A 8/2000 Taylor ..... 347/29
6,406,607 B1 * 6/2002 Hirsh et al. ..... 205/69
6,457,824 B1 * 10/2002 Wexler ..... 347/105

FOREIGN PATENT DOCUMENTS

EP 0638426 A1 2/1995
JP 07331195 12/1995

OTHER PUBLICATIONS

U.S. patent application No. 09/820427; Entitled: Hot–Melt Seal for Nozzles for Print Cartridges and Method; filed Mar. 28, 2001; Applicant: Veronica A. Nelson, et al. pending.

* cited by examiner

*Primary Examiner*—Shih-Wen Hsieh
(74) *Attorney, Agent, or Firm*—Donald J. Coulman

(57) ABSTRACT

A fluid ejection cartridge includes an ejector head having at least one nozzle and a fluid reservoir containing an ejectable fluid, fluidically coupled with the at least one nozzle. The fluid ejection cartridge has a tape that includes a thermoplastic polymer film in contact with and releasably bonded to the nozzles.

42 Claims, 9 Drawing Sheets

*-Prior Art-*

THERMOPLASTIC POLYMER FILM SEALING OF NOZZLES ON FLUID EJECTION DEVICES AND METHOD

BACKGROUND

The present invention generally relates to the sealing of nozzles on fluid ejection devices, and more particularly, to thermoplastic polymer films sealing the nozzles of fluid ejection devices.

Over the past decade, substantial developments have been made in the micro-manipulation of fluids in fields such as electronic printing technology using inkjet printers. The ability to maintain a viable releasable seal of both input and output nozzles or channels in such products is very desirable.

One of the major problems of maintaining a robust seal to micro fluidic channels is the ability, during shipping, handling, and storage, to prevent fluid from leaking out of the channel as well as preventing external material from clogging or entering the channel. The desirable attributes of a seal for micro fluidic channels include the prevention of evaporation, contamination, and intermixing of fluids between channels. In addition, the ability to remove the seal while minimizing the amount of residue left on the input and/or output nozzles or channels is also desirable. Further, it is also desirable that the seal is materially compatible with the fluid (i.e. the seal is not degraded over time by the fluid).

An inkjet print cartridge provides a good example of the problems facing the practitioner in sealing micro fluidic channels. There is a wide variety of highly-efficient inkjet printing systems currently in use, which are capable of dispensing ink in a rapid and accurate manner. Conventionally, the loss of ink and or clogging of the ink ejection nozzles is prevented by either using a capping device or by using a pressure sensitive tape (PSA) (see for example U.S. Pat. No. 5,414,454) in most of these systems. However, there is a corresponding need for improved sealing technologies, as inkjet-printing systems continue to provide ever-increasing improvements in speed and image quality.

Fluid ejection cartridges typically include a fluid reservoir that is fluidically coupled to a substrate that is attached to the back of a nozzle layer containing one or more nozzles through which fluid is ejected. The substrate normally contains an energy-generating element that generates the force necessary for ejecting the fluid held in the reservoir. Two widely used energy generating elements are thermal resistors and piezoelectric elements. The former rapidly heats a component in the fluid above its boiling point causing ejection of a drop of the fluid. The latter utilizes a voltage pulse to generate a compressive force on the fluid resulting in ejection of a drop of the fluid.

In particular, improvements in image quality have led to both a decrease in the size of the nozzles as well as the complexity of ink formulations that increases the sensitivity of the cartridge to residue. Smaller nozzles are more susceptible to plugging from any residue left in a nozzle region when the seal is removed. Nozzles are also more susceptible to clogging from residue left on the nozzle layer that is swept into a nozzle by a service station wiper when the nozzle layer is cleaned. In addition, improvements in image quality have led to an increase in the organic content of inkjet inks that results in a more corrosive environment experienced by the material sealing the nozzles. Thus, degradation of the sealing material by more corrosive inks raises material compatibility issues. In addition, improvement in print speed has typically been gained by utilizing a larger printhead resulting in an increased print swath. The larger printhead results in a larger number of nozzles to be sealed and thus the need to maintain a leak tight seal over a greater area.

Conventional capping devices typically seal the inkjet nozzles using a mechanical structure to apply pressure to a compliant material (typically an elastomeric or resilient foam material), that is pressed or forced against the nozzles resulting in a seal. These devices, however, can suffer leakage during shipping, handling, and storage due to vibration, rough handling, temperature and humidity fluctuations etc., which can result in clogged nozzles or spillage of ink in the cartridge container. This problem is exacerbated when it occurs in ink cartridges containing multiple inks, resulting in ink mixing that typically produces poor color rendition when printed. Although conventional capping materials can be more compatible with the newer aggressive or corrosive inks, the increased print swath increases the likelihood of leaks due to thermal expansion and the bending properties of both the printhead and the capping device.

Conventional PSA tapes on the other hand typically seal the inkjet nozzles using a pressure sensitive adhesive. The PSA tape is generally constructed of a base film with an acrylate based pressure sensitive adhesive layer used to seal the nozzles as shown schematically in FIG. 1. The base film is normally made of polyethylene terephthalate commonly referred to as polyester (PET) or polyvinyl Chloride (PVC). The use of thin PSA tapes has resulted in improving the resistance to environmental variation due to dimensional changes caused by temperature and humidity excursions. PSA tapes have also provided some improvement in durability in regards to vibration, thus, improving upon some of the problems associated with capping devices. However, a PSA tape applied over an irregular surface, such as a protrusion, a stepped structure or a discontinuous surface, can result in the gradual peeling or lifting of the PSA tape resulting in leakage, especially over longer periods of time. The gradual lifting can also result in the formation of an air pocket between the tape and the nozzle plate, allowing ink to flow into this region which will then react or corrode materials such as the encapsulant that protects the electrical traces. Ultimately this may lead to electrical shorts and the print cartridge may fail.

As noted above and shown in a simplified isometric view in FIG. 1 most PSA tapes generally consist of a base film 11 and an adhesive layer 21 with a liner 31 and/or release layer 41 (typically polydimethylsiloxane {PDMS}). During application the liner 31 is removed and discarded. The adhesive layer 21 is bonded to the nozzle layer, using pressure, forming a seal. The adhesive layer is typically an elastomer mixture with large quantities of small molecular additives having a low molecular weight. The additives typically include plasticizers, tackifiers, polymerization catalysts, and curing agents. These low molecular weight additives are added primarily to change the glass transition temperature (Tg) of the material and to provide tack.

Since these additives are low in molecular weight compared to the polymer molecular weight they can both be leached out of the adhesive layer by the ink, react with ink components, or both, more easily than the polymer backbone. In either case, whether the low molecular weight material reacts with, or is leached out by the ink, the adhesive layer of the PSA tape is left with a weakened cohesive strength which can result in a residue being left behind when the tape is removed. In addition, the reaction between these low molecular weight additives and ink components can also lead to the formation of precipitates or gelatinous materials, which can further result in clogging of the nozzles.

The interaction of these low molecular weight additives and the ink components can also give rise to a weakening of the base/adhesive film interface. Thus, if the strength of this interface is sufficiently degraded, the adhesive layer of the tape can remain on the print cartridge when the user attempts to pull the tape off before inserting the cartridge into the printer. The material compatibility of both the base film as well as the adhesive film is carefully chosen for each ink. The material compatibility of the ink/additive interactions as well as the general ink/polymer interactions should be considered.

Regardless of the method used to eject the fluid, once a fluid ejection cartridge is manufactured, filled with fluid, and tested there is a need to seal the nozzle or nozzles to prevent leakage, reduce evaporation of the fluid, and to hinder contamination of the fluid. Thus, practitioners are often faced with difficult choices between capping devices (greater ink robustness); PSA tapes (better sealing properties) and changes in ink formulation to meet the shipping, handling, and storage requirements for a particular fluid ejection cartridge.

Thus a sealing system that prevents fluid leakage, evaporation, contamination, and intermixing between channels, as well as being easily removable while minimizing the residue left on a variety of nozzle plates and is compatible with a variety of inks would be an advance in the art.

SUMMARY OF THE INVENTION

A fluid ejection cartridge includes an ejector head having at least one nozzle and a fluid reservoir containing an ejectable fluid, fluidically coupled with the at least one nozzle. The fluid ejection cartridge has a tape that includes a thermoplastic polymer film in contact with and releasably bonded to the nozzles.

DESCRIPTION OF THE PREFERRED EMBODIMENTS

A feature of the present invention includes the use of a thermoplastic polymer film that maintains the sealing properties of a PSA tape while also maintaining the ink robustness of a capping device. By using higher sealing temperatures and pressures along with minimizing the use of additives, the practitioner is able to optimize the ink formulation and the sealing properties of the thermoplastic polymer film. Thus the present invention advantageously uses a thermoplastic polymer film optimized for ink compatibility and also utilizes higher sealing temperatures and pressures to form a robust seal around the nozzles of a fluid ejection cartridge.

The thermoplastic polymer film can be a thermoplastic crystalline or semi-crystalline polymer or a thermoplastic elastomer that has a melting point greater than about 35° C.; preferably a melting point from about 60° C. to about 150° C., particularly preferable is a melting point from about 70° C. to about 120° C. The thermoplastic polymer film has little or no tack at room temperature. In addition, the thermoplastic polymer film also preferably has a melt index of from about 0.5 to about 5.0 g/min according to the American Society for Testing and Materials (ASTM) standard D1238, and more preferably a melt index of from about 0.5 to about 1.0 g/min. However, a thermoplastic polymer film having a melt index in the range of from about 0.5 to about 50 g/min can be utilized. The thermoplastic polymer film has the advantages of being mechanically strong, resistant to a wider range of fluids than PSA's, contains little or no additives, and typically has lower water vapor transmission rates than PSA's. In addition, the thermoplastic polymer film conforms well around abrupt structural features on the fluid ejection device. More importantly, the thermoplastic polymer film provides the ability to tune the adhesion properties by using different sealing temperatures, pressures, and times, thus optimizing the sealing properties for different fluid ejection cartridges.

Figure 1:
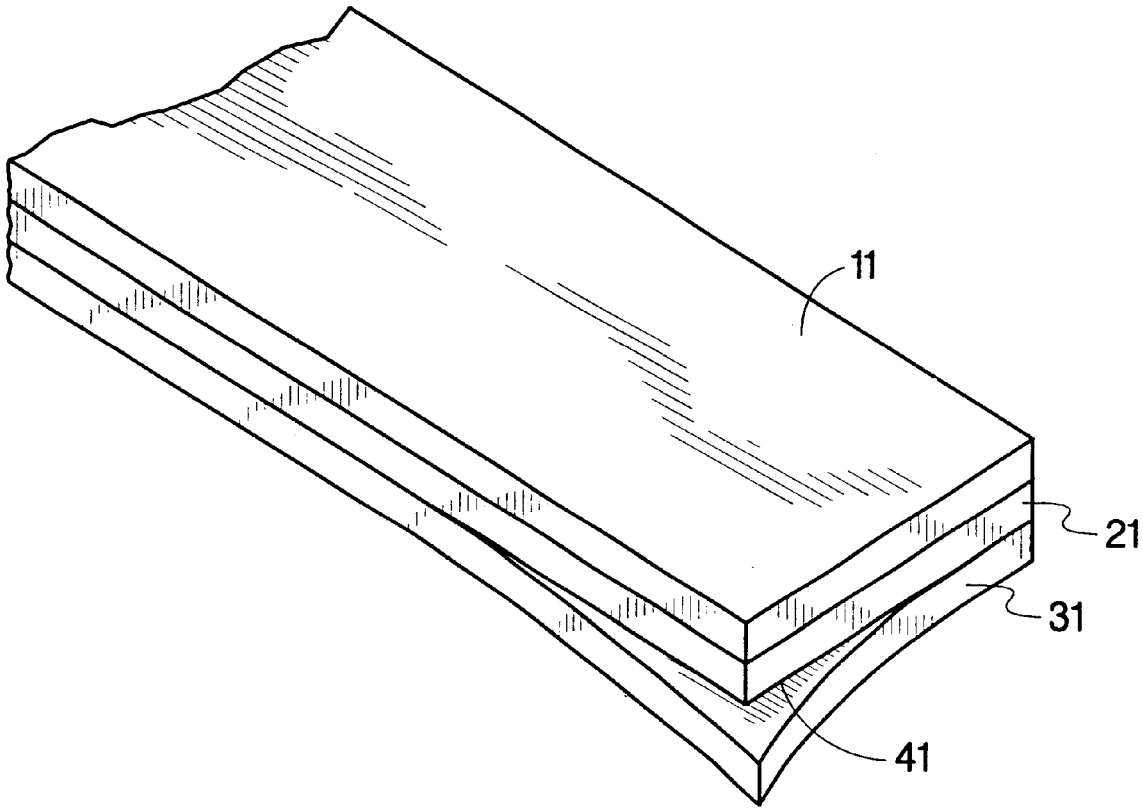
FIG. 1 is a perspective view generally depicting the structure of a PSA tape.
Figure 2:
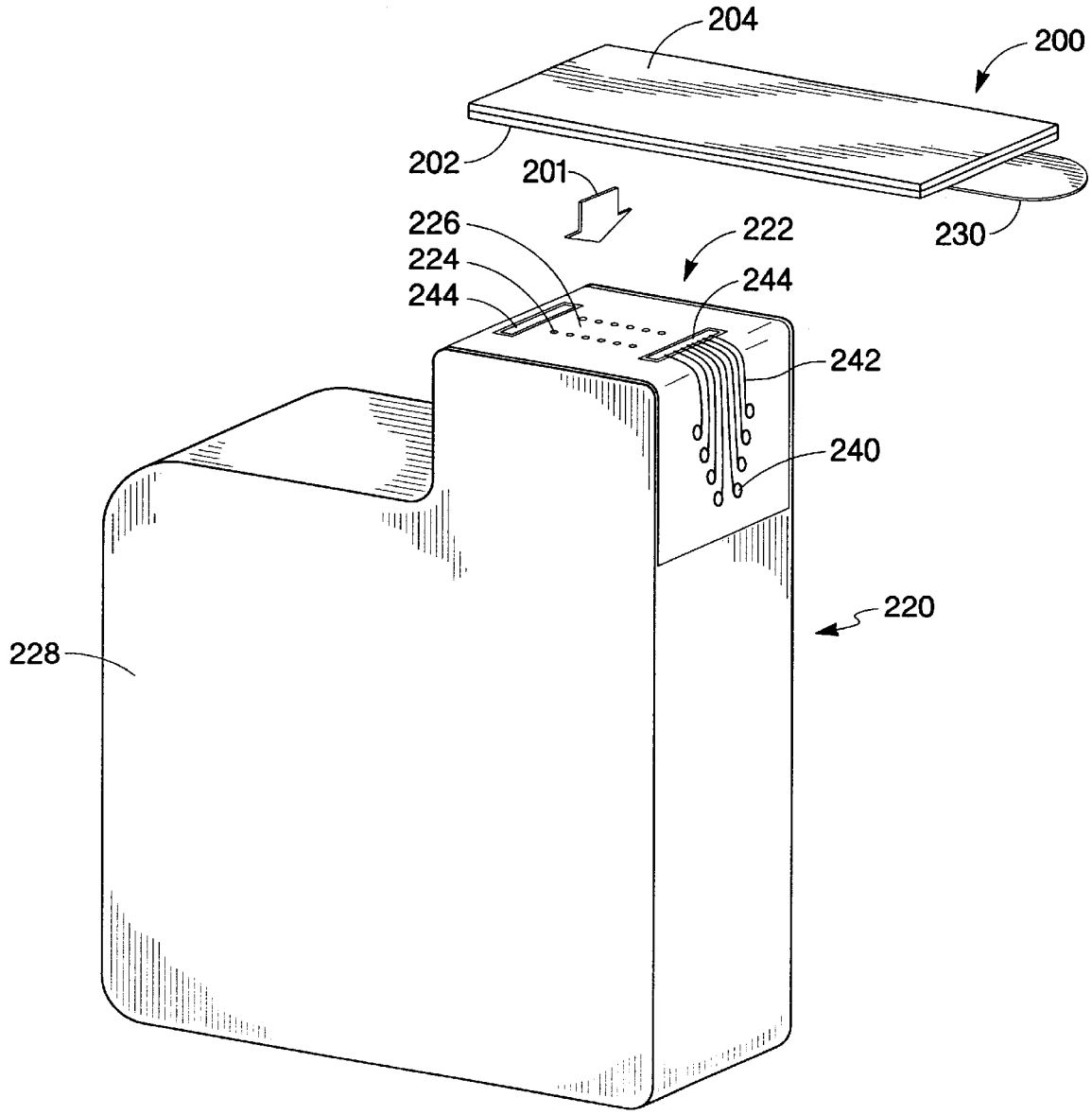
FIG. 2 is a perspective view of a fluid ejection cartridge and a tape according to an embodiment of this invention.

Referring to FIG. 2, an exemplary embodiment of a fluid ejection cartridge 220 of the present invention is shown in a perspective view. In this embodiment, the fluid ejection cartridge 220 includes a reservoir 228 that contains a fluid which is supplied to a substrate (not shown) that is secured to the back of a nozzle layer 226. The substrate (not shown), the nozzle layer 226, nozzles 224, and a flexible circuit 222 form what is generally referred to as an ejector head. In those embodiments which do not utilize an integrated nozzle layer and flexible circuit the substrate, the nozzle layer and the nozzles would generally be referred to as the ejector head.

The nozzle layer 226 contains one or more nozzles 224 through which fluid is ejected. The nozzle layer 226 may be formed of metal, polymer, glass, or other suitable material such as ceramic. Preferably, the nozzle layer 226 is formed from a polymer such as polyimide, polyester, polyethylene naphthalate (PEN), epoxy, or polycarbonate. Examples of commercially available nozzle layer materials include a polyimide film available from E. I. DuPont de Nemours & Co. under the trademark "Kapton", a polyimide material available from Ube Industries, LTD (of Japan) under the trademark "Upilex", and a photoimagible epoxy available from MicroChem Corp. under the trademark NANO SU-8. In an alternate embodiment, the nozzle layer 226 is formed from a metal such as a nickel base enclosed by a thin gold, palladium, tantalum, or rhodium layer.

The flexible circuit 222 of the exemplary embodiment is a polymer film and includes electrical traces 242 connected to electrical contacts 240. The electrical traces 242 are routed from the electrical contacts 240 to bond pads on the substrate (not shown) to provide electrical connection for the fluid ejection cartridge 220. When the flexible circuit 222 and nozzle layer 226 are integrated as shown in FIG. 2, raised encapsulation beads 244 (typically an epoxy) are dispensed within a window formed in the integrated flexible circuit 222 and nozzle layer 226. The encapsulation beads 244 protect and encapsulate the electrical trace 242 and bond pad electrical connections on the substrate. In an alternate embodiment, when nozzle layer 226 is not integrated into flexible circuit 222 the encapsulation beads 244 are dispensed along the edge of nozzle layer 226 and the edge of the substrate to provide the protection function for the electrical connections to the substrate.

Once the manufacture of the fluid ejection cartridge is complete and the reservoir 228 is filled with fluid, and the appropriate testing of the fluid ejection cartridge is completed the nozzles 224 should then be sealed to prevent leakage and/or to prevent contamination of the fluid. The tape 200 shown in FIG. 2 is initially provided on a roll, cut to the appropriate length, and aligned with the fluid ejection cartridge 220 such that the tape 200 will fully cover the nozzles 224. The tape 200 is then pressed onto the fluid ejection cartridge 220 in the direction of arrow 201 using a heated platen (not shown) to heat the thermoplastic polymer film 202 above its melting temperature and to apply pressure. The thermoplastic polymer film 202 is heated to above its melting temperature, preferably 10° C. to 50° C. above the melting temperature and more preferably 25° C. to 50° C. above the melting temperature. The tape 200 may also be provided with a non-sticking tab 230, commonly referred to as a pull-tab, to facilitate gripping of the tape 200 by the user for removal.

The tape 200 shown in a perspective view in FIG. 2 is a two-layer construction where the thermoplastic polymer film 202 is adhesively bonded to the base film 204. Preferably, the base film 204 is a polyester (PET) film. Other polymer film materials may also be used for the base film such as polyvinyl chloride, polybutylene terephthalate (PBT), polyethylene naphthalate (PEN) polypropylene (PP), polyethylene (PE), polyurethane, polyamide, polyarylates, and polyester based liquid-crystal polymers. The base film 204 can also be a woven or non-woven base, where a non-woven base is a flat porous sheet typically produced by interlocking layers or networks of fibers, filaments, or film-like filamentary structures. The non-woven base is specifically designed to allow thorough penetration of the impregnating resin inside the very porous base film. Materials commonly used to make non-woven sheets are polyesters, polypropylene, and rayon.

Although the thickness of the base film 204 will depend both on the particular fluid ejection cartridge being sealed and the particular thermoplastic polymer film used, the thickness of the base film 204 preferably ranges from about 5 to about 500 microns and more preferably from about 5 to about 50 microns thick and particularly preferable is a range from about 10 to about 25 microns thick. It is also preferable that the base film 204 has a melting temperature at least 10° C. higher than that of the thermoplastic polymer film 202, more preferable at least 25° C. higher, and particularly preferable is a melting temperature at least 50° C. higher.

The thermoplastic polymer film 202 preferably is ethylene-based binary or ternary copolymers. Examples of such copolymers include ethylene-vinyl acetate copolymers with a vinyl acetate content between from about 0 to about 40 weight percent, and more preferably with a vinyl acetate content between from about 10 to about 25 weight percent. Another example is copolymers of ethylene-methacrylic acid with a methacrylic acid content between from about 5 to about 30 weight percent, and more preferably a methacrylic acid content between from about 10 to about 20 weight percent. Another example is ethylene-vinyl acetate-methacrylic acid terpolymers, and ethylene-acrylic ester-glycidyl methacrylate terpolymers. A particularly preferable semi-crystalline ternary copolymer film contains from about 60 to about 95 weight percent polyethylene, and from about 0 to about 40 weight percent polyvinyl acetate, and from about 0 to about 30 weight percent polymethacrylic acid. The acid groups in the copolymer can be partially neutralized. Other materials may also be used for the thermoplastic polymer films such as polyurethanes, polyamide, and polyester. Blends of these polymers, such as EVA/PP or EVA/PE, can also be utilized.

Although the thickness of the thermoplastic polymer film 202 will depend both on the particular fluid ejection cartridge being sealed and the particular thermoplastic polymer film used the thickness of the thermoplastic polymer film 202 preferably ranges from about 5 to about 500 microns and more preferably from about 10 to about 100 microns thick and particularly preferable is a range from about 25 to about 75 microns thick. It is also preferable that the thermoplastic polymer film 202 has a melting temperature around from about 60° C. to about 150° C., and more preferably from about 70° C. to about 120° C., however, films with melting temperatures above about 35° C. can be utilized.

It is preferable that the thermoplastic polymer film 202 contains less than about 10 percent low molecular weight additives, having molecular weights less than about 2000 grams per mole, such as plasticizers, tackifiers, and also be halogen free. It is more preferable that the thermoplastic polymer film 202 not contain low molecular weight additives. However, thermoplastic polymer films that contain less than from about 20 to about 30 weight percent low molecular weight additives can be utilized. Examples of various compounds that can be used as processing agents are adipates, such as di-2-ethylehxyl adipate; phosphates, such as 2-ethylhexyl diphenyl phosphate; phthalates, such as diisotridecyl phthalate or di-2-ethylhexyl phthalate; secondary plasticisers, such as sorbitan sesquioleate, epoxidised linseed or soybean oils; slip and antiblock agents such as oleamide, erucamide, and stearamide, and other similar materials.

As noted above an advantage of the present invention is the ability to adjust the adhesion of the thermoplastic polymer film 202 to the nozzle layer 226, by varying the temperature, pressure, and time during application. In addition, the adhesion can also be adjusted by varying the crosslinking density of the polymer or polymers used in the thermoplastic polymer film 202. Although the degree of crosslinking of the thermoplastic polymer film 202 will depend on the particular fluid ejection cartridge being sealed, the particular thermoplastic polymer film used, as well as the particular fluid used in the fluid ejection cartridge, preferably the degree of crosslinking is controlled by electron beam irradiation in the range of from about 0 to about 30 mrad, which can result in more than an order of magnitude variation in peel strength, and more preferably in the range of from about 0 to about 10 mrad. Other crosslinking technologies such as chemical or ultraviolet light (UV) activated systems, or other electromagnetic radiation activated systems can be used as well.

The adhesion between the base film 204 and the thermoplastic polymer film 202 can also be adjusted by pretreating the base film 204 before application of the thermoplastic polymer film. Preferably, either plasma treating or corona discharge treating of the base film 204 with a reactive gas such as oxygen is used. However, other surface treatments such as laser, flame, chemical, or by applying a coupling agent can also be utilized.

Figure 3:
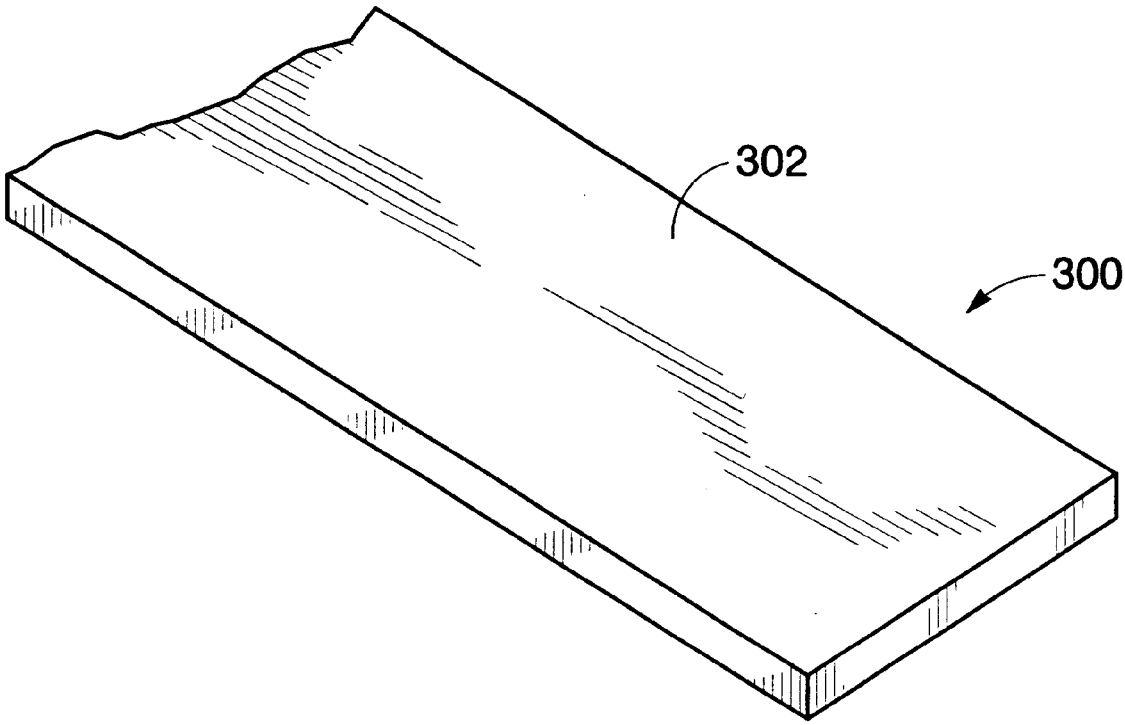
FIG. 3 is a perspective view of a tape according to an alternate embodiment of this invention.

An alternate embodiment of the present invention is shown in FIG. 3 where tape 300 is a single layer construction formed from the thermoplastic polymer film 302. In this embodiment, the thermoplastic polymer film can be any of the polymers described for the embodiment shown in FIG. 2. Although the thickness of the thermoplastic polymer film 302 will depend both on the particular fluid ejection cartridge being sealed and the particular thermoplastic polymer film used the thickness of the thermoplastic polymer film 302 is from about 20 to about 500 microns thick and more preferably from about 25 to about 175 microns thick, and particularly preferable from about 115 to about 135 microns thick. In addition, in this embodiment, preferably heat is applied to the tape from the fluid ejection cartridge side using either hot air or infrared heating to form a surface melted region during application without melting the entire film.

Figure 4A:
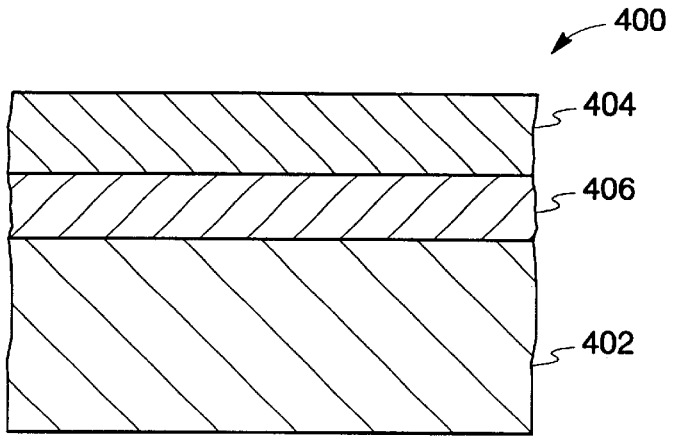
FIG. 4*a* is a cross-section view of a tape according to an alternate embodiment of this invention.

FIG. 4*a* shows an alternate embodiment of the present invention is shown in a cross-sectional view. In this embodiment, a tape 400 is a three layer construction where a thermoplastic polymer film 402 is adhesively bonded to a moisture barrier film 406 that is adhesively bonded to a base film 404. Both the base film 404 and thermoplastic polymer film 402 can be any of the polymers respectively described for the embodiment shown in FIG. 2. Although the total thickness of the tape 400 will depend both on the particular fluid ejection cartridge being sealed and the particular thermoplastic polymer film used, preferably the total thickness is in the range from about 20 to about 150 microns, and more preferably in the range from about 25 to about 100 microns in thickness, and particularly preferable is the range from about 25 to about 75 microns. Although FIG. 4*a* depicts a construction with the moisture barrier film 406 sandwiched between the base film 404 and the thermoplastic film 402 it is equally preferable that the base film 404 is sandwiched between the moisture barrier film 406 and the thermoplastic polymer film 402 depending on the particular materials used for the moisture barrier film 406.

Preferably, the moisture barrier film 406 is polyethylene, however, other materials can be utilized such as liquid crystal polymers, and even a metal or inorganic layer can be used. Although the thickness of the moisture barrier layer will depend both on the particular fluid ejection cartridge being sealed and the materials used for both the base film 404 and the thermoplastic polymer film 402 a range from about 0.01 to about 25 microns is preferable, a range from about 0.5 to about 15 microns is more preferable.

Figure 4B:
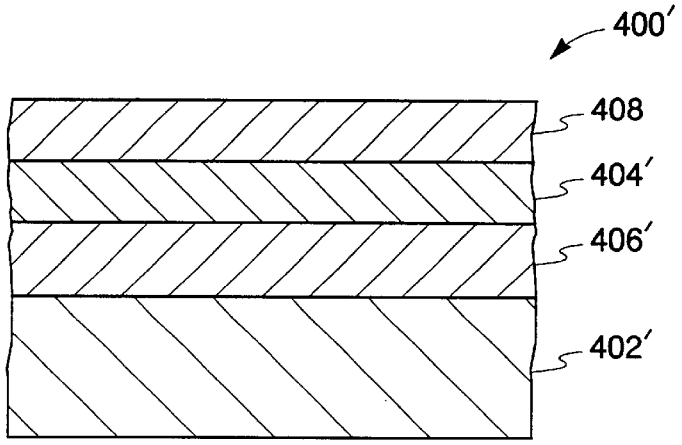
FIG. 4*b* is a cross-section view of a tape according to a second alternate embodiment of this invention.

A second alternate embodiment of the present invention is shown, in a cross-sectional view, in FIG. 4*b*. In this embodiment, the tape 400' is a four layer construction where a thermoplastic polymer film 402' is adhesively bonded to a moisture barrier film 406' that is adhesively bonded to a base film 404' that is adhesively bonded to an electrostatically dissipating film 408. The base film 404', the thermoplastic polymer film 402', and moisture barrier film 406' can be any of the polymers respectively described for the embodiments shown in FIG. 2 or FIG. 4*a*. In addition, the moisture barrier film 406' and electrostatically dissipating film 408, depending on the particular films used, can act as a base film thereby replacing the base film 404'. Although the thickness of the tape 400' will depend both on the particular fluid ejection cartridge being sealed and the particular thermoplastic polymer film 402' used the thickness of the tape 400' preferably ranges from about 20 to about 150 microns, and more preferably from about 25 to about 100 microns, and particularly preferable is a range from about 25 to about 75 microns. Although FIG. 4*b* depicts a construction with the moisture barrier film 406' sandwiched between the base film 404' and the thermoplastic film 402' with the electrostatically dissipating film 408 that is adhesively bonded to the remaining free side of the base film 404', other constructions are equally preferable as long as the thermoplastic polymer film 402' is bondable to the nozzle layer as shown in FIG. 2. For example, the electrostatically dissipating film 408 can also be sandwiched between the base film 404' and the thermoplastic polymer film 402'.

Preferably, the electrostatically dissipating film 408 is treated polyethylene with a surface resistivity from about $10^9$ to about $10^{13}$ ohms/square, however, other materials can be utilized such as carbon black filled polymers, and even a metal formed on the surface of the electrostatically dissipating film 408. Although the thickness of the electrostatically dissipating film 408 will depend both on the particular fluid ejection cartridge being sealed and the materials used for both the base film 404' and the thermoplastic polymer film 402' a range from about 0.5 to about 25 microns is preferable. For those fluid ejection devices that contain sensitive circuitry to protect, such as complimentary metal oxide semiconductors (CMOS), electrostatically dissipating film 408 preferably has a surface resistivity of $10^4$ ohms per square. The electrostatically dissipating film 408 preferably contains a static dissipating material such as the treated polyethylene to control triboelectric charging and a conductive layer such as a thin metal layer to act as a shield against electrostatic fields.

Figure 4C:
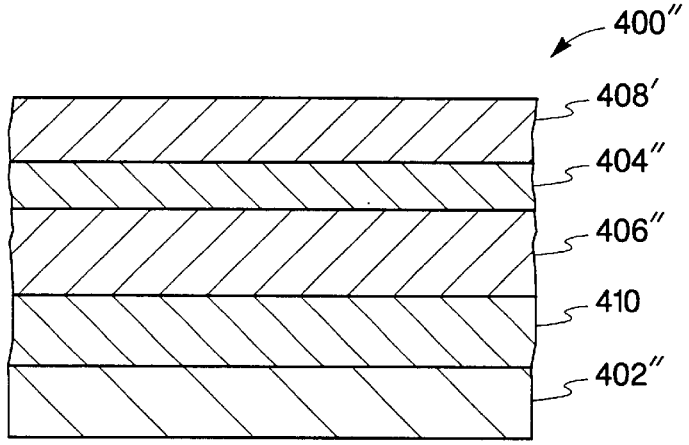
FIG. 4*c* is a cross-section view of a tape according to a third alternate embodiment of this invention.

Referring to FIG. 4*c*, a third alternate embodiment of the present invention is shown in a cross-sectional view. In this embodiment, the tape 400" is a five layer construction where a thermoplastic polymer film 402" is adhesively bonded to an air barrier film 410; the air barrier film 410 is adhesively bonded to moisture barrier film 406"; the moisture barrier film 406" is adhesively bonded to a base film 404"; and the base film 404" is adhesively bonded to an electrostatically dissipating film 408'. The base film 404", the thermoplastic polymer film 402", and moisture barrier film 406" and the electrostatically dissipating film 408' can be any of the polymers respectively described for the embodiments shown in FIG. 2 or FIGS. 4*a*–4*b*. Preferably, the air barrier film 410 is a liquid crystal polymer film; however, other materials such as metal layers or inorganic layers (e.g. silicon dioxide, aluminum oxide etc.) can also be used.

Although the thickness of the tape 400" will depend both on the particular fluid ejection cartridge being sealed and the particular thermoplastic polymer film 402" used the thickness of the tape 400' preferably ranges from about 20 to about 500 microns, and more preferably from about 25 to about 100 microns, and particularly preferable is a range from about 25 to about 75 microns. Although FIG. 4*c* depicts a construction with the moisture barrier film 406" and the air barrier film 410 sandwiched between the base film 404" and the thermoplastic film 402" with the electrostatically dissipating film 408' that is adhesively bonded to the remaining free side of the base film 404", other constructions are equally preferable as long as the thermoplastic polymer film 402" is bondable to the nozzle layer as shown in FIG. 2.

Figure 5:
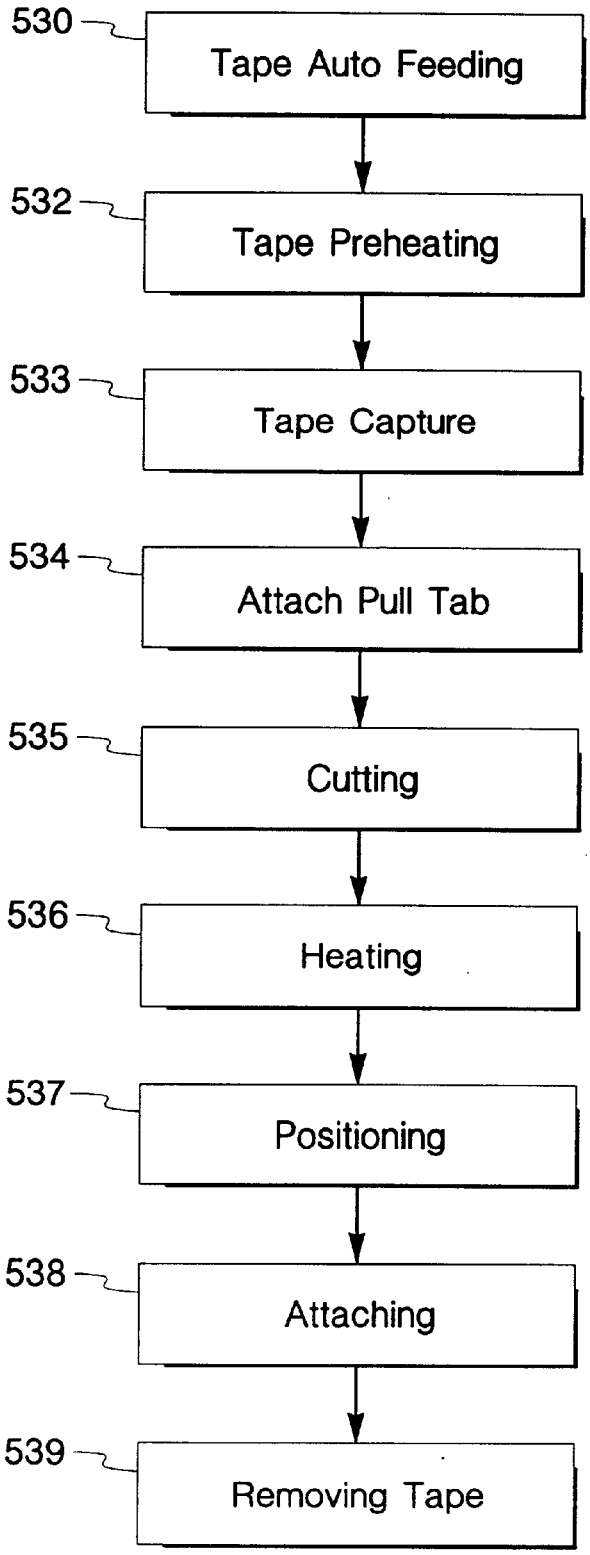
FIG. 5 is a flow diagram of a method to seal nozzles of a fluid ejection cartridge according to an embodiment of this invention.

An exemplary method of releasably sealing the nozzles of a nozzle layer on a fluid ejection cartridge using a tape as described in the various embodiments shown in FIGS. 2–4 is shown as a flow diagram in FIG. 5. At step 530 the tape is dispensed from a reel that holds the tape during manufacturing. The tape is advanced off the reel by a combination of a drive roller and an idler roller that keeps the tape in proper tension and alignment preventing both twisting and slacking or drooping. At step 532 as the tape is advanced off the reel the tape is fed into a heating zone to preheat the tape such that the downstream process of attaching the tape to the fluid ejection cartridge can be sped up resulting in the ability to maximize throughput. Preferably, the tape is preheated to a temperature in the range of from about 10° C. to about 50° C. above the melting temperature of the thermoplastic polymer film, and more preferably from about 25° C. to about 50° C., however, depending on the particular tape being utilized preheating temperatures higher than about 50° C. above the melting temperature can be used.

Figure 6:
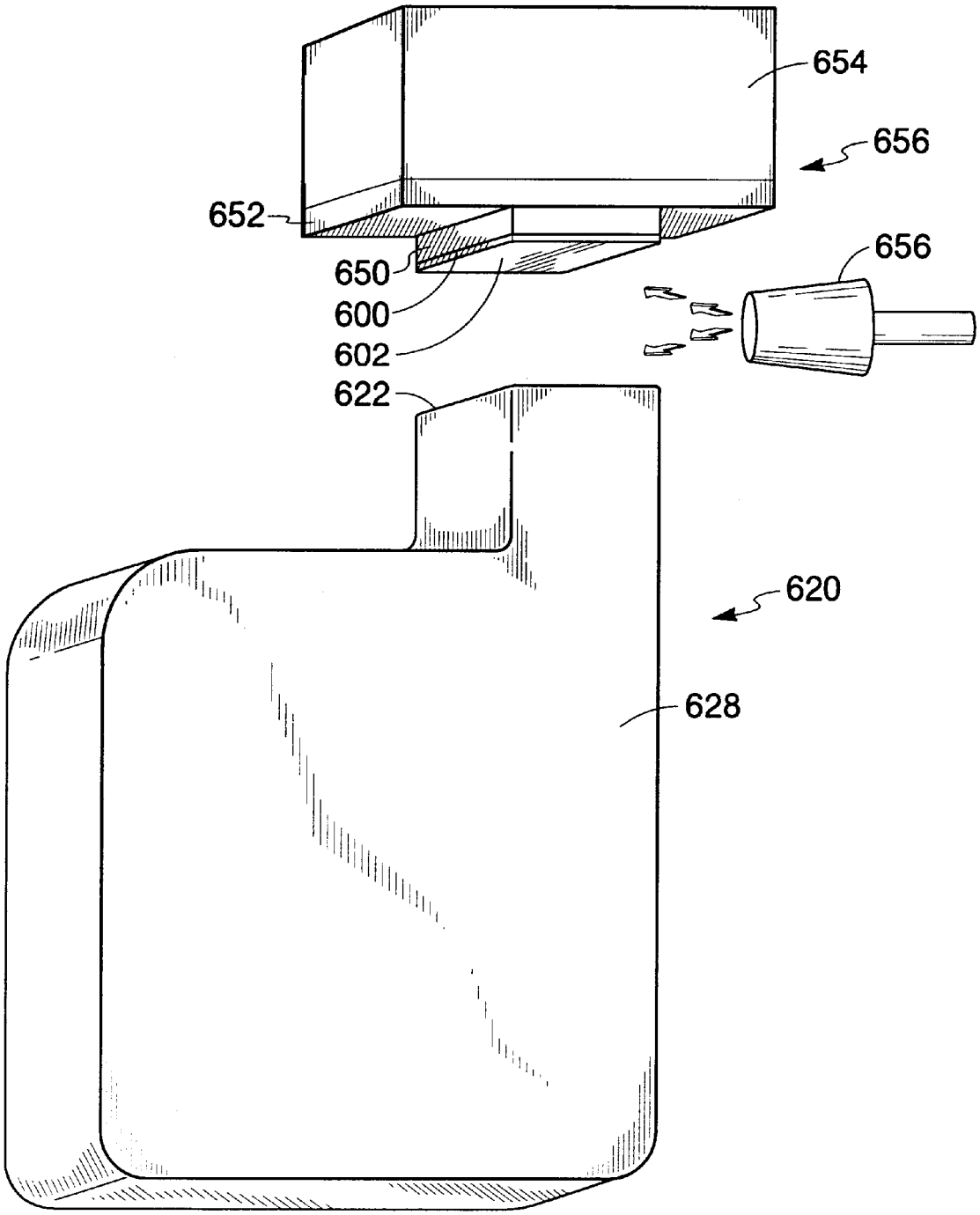
FIG. 6 is a perspective view of a method to seal nozzles of a fluid ejection cartridge according to an alternate embodiment of this invention.

The tape is then releasably captured in step 533 using a vacuum chuck that can be moved in three mutually perpendicular directions to properly position the tape over the fluid ejection cartridge as shown in FIG. 6. After the tape has been releasably captured, a pull-tab is attached to the free end of the tape to facilitate gripping of the tape by the user for removal. A cutter or slitting device then cuts the tape to its required length in step 535.

The vacuum chuck that releasably captures the tape in step 533 also includes a heater that heats the tape in step 536 to a sufficiently high temperature to facilitate attaching the tape to the nozzle surface layer shown in FIG. 2. Preferably, the heater heats the tape to a temperature in the range of from about 110° C. to about 125° C. within from about 2 to about 7 seconds, however, other temperatures and times can also be utilized depending on the particular fluid ejection cartridge, tape used and manufacturing tooling utilzed. As the heater of the vacuum chuck is heating the tape, the vacuum chuck also positions the tape over the fluid ejection cartridge to cover the nozzle or nozzles in step 537.

Once the cut tape is both positioned correctly and the tape is at the desired temperature, the vacuum chuck attaches the tape to the fluid ejection cartridge in step 538. In this step, preferably a pressure of from about 30 to about 60 psi is applied between the tape and the fluid ejection cartridge, and more preferably in the range of from about 40 to about 50 psi, however pressures in the range of from about 7 to about 100 psi can also be used depending on the particular fluid ejection cartridge and tape being utilized. In addition, the particular pressure used in step 538 also depends upon other factors such as, the flatness of the vacuum chuck, the flatness of the pen surface to which the tape is being laminated, the durometer of a compliant material if used on the vacuum chuck, and the parallelism of the two surfaces during lamination. In step 539, the user removes the tape at room temperature before utilizing the fluid ejection cartridge.

Referring to FIG. 6 an alternate embodiment of the method of releasably sealing the nozzles of a nozzle layer on a fluid ejection cartridge using a tape as described in the various embodiments shown in FIGS. 2–4 is shown as a perspective view. More particularly, the alternate embodiment shown in FIG. 6 shows an alternate method of heating the tape before attaching the tape to the fluid ejection device. In this embodiment, the vacuum chuck 656 is similar to that described above in steps 533 through 538. The vacuum chuck includes a heater 652 attached to the heater support 654. Attached to the heater 652 is a compliant material 650 that is preferably a silicone rubber, however, other compliant materials that can operate in the desired temperature range can also be used. The compliant material contains at least one hole though which a vacuum is applied to hold tape 600 in a substantially flat manner. Preferably, complaint material contains a plurality of holes to hold the tape 600 in its proper position. In this embodiment surface heater 656 is positioned to heat both the nozzle surface layer of the fluid ejector head 622 and the sealing surface 603 of the thermoplastic polymer film layer of tape 600.

The fluid ejector head is attached to fluid reservoir 628 to form fluid ejection cartridge 620 similar to fluid ejection cartridge 220 shown in FIG. 2. This embodiment is particularly advantageous for the tape embodiment shown in FIG. 3 where the tape 600 is a single layer construction where it is desirable to melt only the surface of the thermoplastic polymer film. As shown in FIG. 6 surface heater 656 heats the two surfaces by using hot air or some heated inert gas such as nitrogen or argon. However, other heating methods can be utilized such as infrared heating, microwave heating, and laser heating.

Figure 7A:
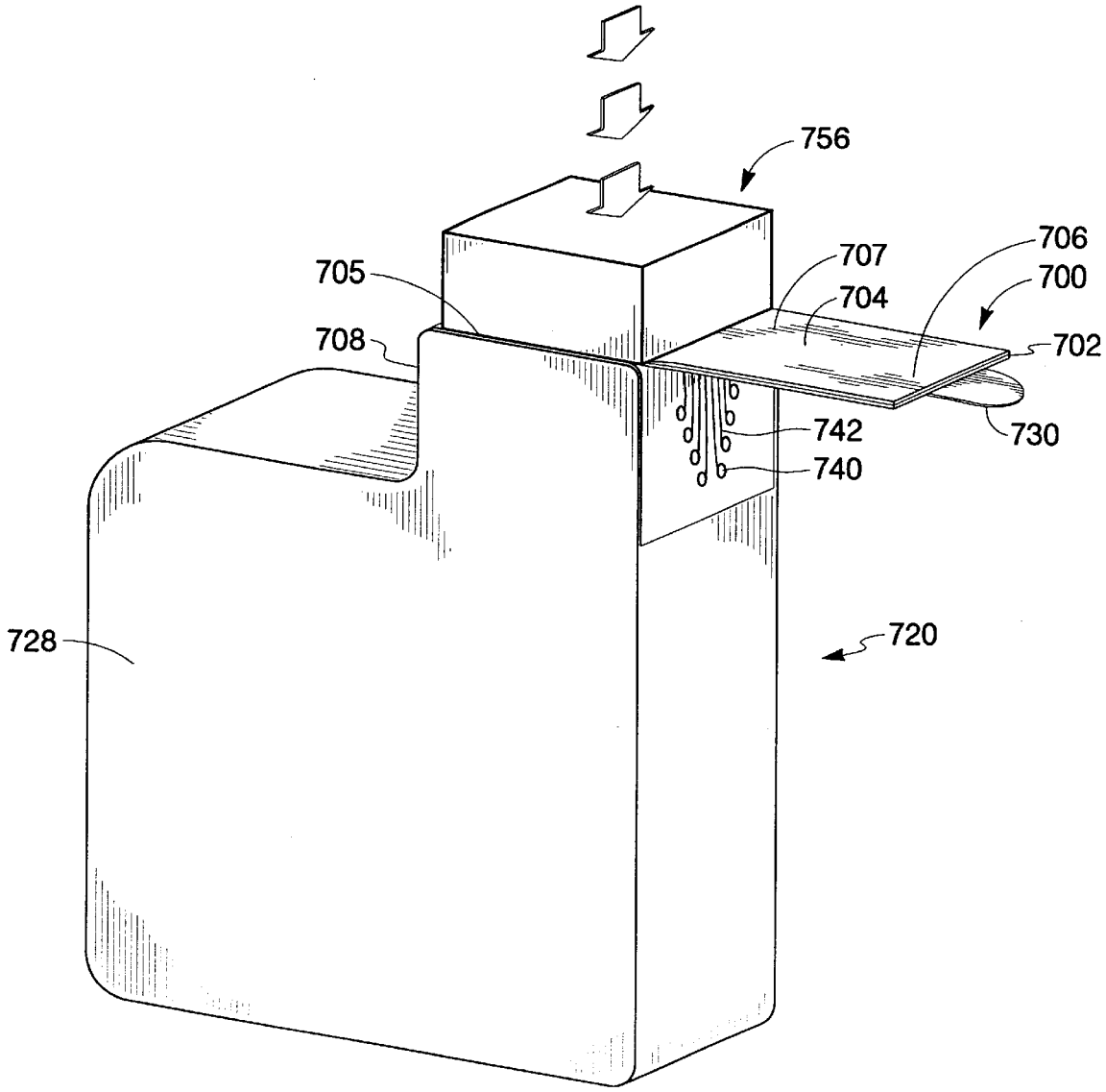
FIGS. 7*a*–7*b* are perspective views of a method to seal nozzles of a fluid ejection cartridge according to an alternate embodiment of this invention.
Figure 7B:
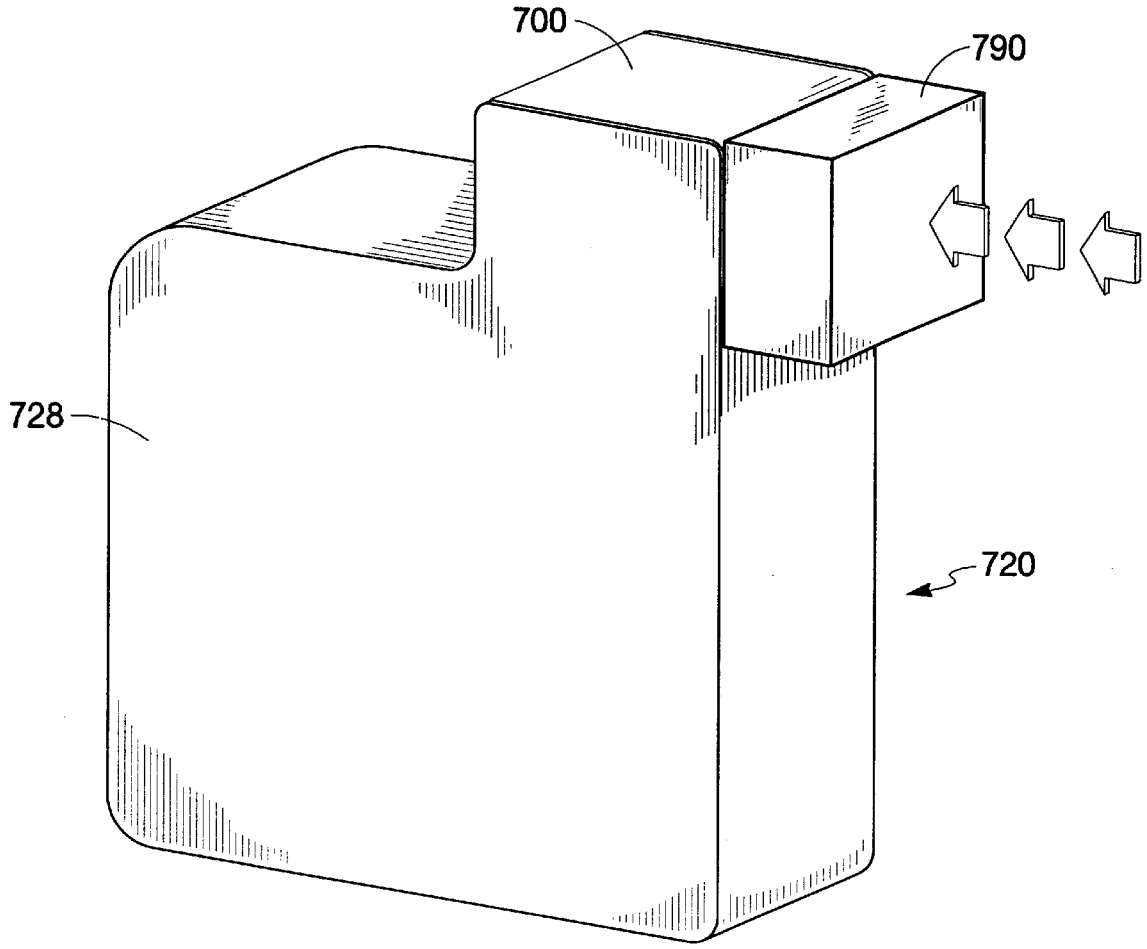

Referring to FIGS. 7*a*–7*b* an alternate embodiment of the method of releasably sealing the nozzles of a nozzle layer on a fluid ejection cartridge using a tape as described in the various embodiments shown in FIGS. 2–4 is shown in a perspective view. More particularly, the alternate embodiment shown in FIGS. 7*a*–7*b* shows a method to attach tape 700, to the nozzle layer (not shown) using a first portion 705 of the tape 700; to the reservoir 728 using a second portion 706 of the tape 700; and to the electrical traces 742 and electrical contacts 740 using a third portion 707 of the tape 700. This is particularly advantageous for those fluid ejection cartridges 720 that have electrical contacts and traces in close proximity to the fluid ejection nozzles.

In this embodiment, vacuum chuck 756 stakes the tape 700 to the nozzle layer (not shown) using the first portion 705, similar to that described in step 538 shown in FIG. 5, by heating tape 700 and applying pressure to the base film 704 resulting in the thermoplastic film 702 sealing the nozzles in the nozzle layer. As shown in FIG. 7*b* a second laminator 790 or vacuum chuck 756 rotated ninety degrees, then preferably laminates the second portion 706 of the tape 700 to the reservoir 728, and laminates the third portion 707 over the electrical traces 742 and electrical contacts 740; providing a robust seal for the nozzles, the electrical traces 742 and electrical contacts 740, leaving the pull tab 730 free to facilitate gripping of the tape 700 by the user for removal. In an alternate embodiment the second portion 706 is laminated to reservoir face 708 using a third laminator (not shown) or vacuum chuck 756 rotated minus ninety degrees.

The following examples illustrate various polymer systems that have been constructed and tested and which can be used according to the present invention. The present invention, however, is not limited to these examples.

Comparative Example 1

Tape 1: A pressure sensitive adhesive (PSA) of from about 5-micron in thickness was solution-cast on a base film of from about 70-micron in thickness. The PSA was acrylate-based and the base film was polyvinyl chloride (PVC). The non-adhesive side of the PVC base film was coated with a thin layer of a silicone material. The tape was heated to about 60° C. and attached to the nozzle layer of a fluid ejection cartridge with a pressure of 45 psi.

Comparative Example 2

Tape 2: A PSA of about 4-micron thickness was solution-cast on a base film of about 50-micron in thickness. The PSA was rubber-based and the base film is an ethylene-based copolymer commercially available from E. I. DuPont de Nemours & Co. under the trademark SURLYN® series resins. A PET-based film was used as a release liner for the tape. The tape was heated to about 60° C. and attached to the nozzle layer of a fluid ejection cartridge with a pressure of 45 psi.

Example 3

Tape 3: A thermoplastic film tape was prepared by extrusion casting a 38 micron thick ethylene-vinyl acetate copolymer (EVA) as a thermoplastic polymer adhesive on a 14.2 micron thick PET base film. The EVA copolymer is commercially available from E. I. DuPont de Nemours & Co. under the trademark ELVAX® 3190. The tape surface was heated to about 120° C. and attached to the nozzle layer of a fluid ejection cartridge with a pressure of 45 psi.

Example 4

Tape 4: A thermoplastic film tape was prepared in the same manner as tape 3 except that the thermoplastic adhesive was an ethylene-vinyl acetate-methacrylate acid terpolymer commercially available from E. I. DuPont de Nemours & Co. under the trademark ELVAX® 4260. The tape surface was heated to about 120° C. and attached to the nozzle layer of a fluid ejection cartridge with a pressure of 45 psi.

Example 5

Tape 5: A thermoplastic film tape was prepared in the same manner as tape 3 except that the thermoplastic adhesive was an ethylene-vinyl acetate copolymer crosslinked using a 10 mrad electron beam dose. The copolymer is commercially available from E. I. DuPont de Nemours & Co. under the trademark ELVAX® 3170. The tape surface was heated to about 130° C. and attached to the nozzle layer of a fluid ejection cartridge with a pressure of 45 psi.

Example 6

Tape 6: A thermoplastic film tape was prepared in the same manner as tape 3 except that the thermoplastic adhesive was an ethylene-methacrylic acid copolymer partially neutralized by metal ions. The copolymer is commercially available from E. I. DuPont de Nemours & Co. under the trademark SURLYN® 1601. The tape surface was heated to about 145° C. and attached to the nozzle layer of a fluid ejection cartridge with a pressure of 45 psi.

Example 7

Tape 7: A thermoplastic film tape was prepared in the same manner as tape 3 except that the thermoplastic adhesive was an ethylene-glycidyl methacrylate based copolymer. The copolymer is commercially available from Atofina Chemicals Inc. under the trademark LOTADER® 8840. The tape surface was heated to about 145° C. and attached to the nozzle layer of a fluid ejection cartridge with a pressure of 45 psi.

Example 8

Tape 8: A thermoplastic film tape was prepared in the same manner as tape 3 except that the thermoplastic adhesive was ELVAX® 4260 crosslinked using a 5 mrad electron beam dose. A biaxially oriented polypropylene film of about 17.8 microns in thickness was used as the base film. The tape surface was heated to about 120° C. and attached to the nozzle layer of a fluid ejection cartridge with a pressure of 45 psi.

Example 9

Tape 9: A thermoplastic film tape was a single layer 127 microns thick, of an ethylene-vinyl acetate copolymer, blown extrusion film. The film is commercially available from E. I. DuPont de Nemours & Co. under the trademark of ELVAX® 3170. The tape surface was heated to about 140° C. and attached to the nozzle layer of a fluid ejection cartridge with a pressure of 45 psi.

Example 10

Tape 10: A thermoplastic film tape was prepared in the same manner as tape 8 except that the base film was a puncture and tear resistant polyester film of about 25 microns in thickness. The tape surface was heated to about 120° C. and attached to the nozzle layer of a fluid ejection cartridge with a pressure of 45 psi.

Evaluation methods

The fluid ejection cartridge employed for the testing has 6 columns of nozzles on about 8×8 mm area of a metal orifice plate. Each column has 72 nozzles. The cartridge was filled with a water-based fluid containing different colors such as cyan, magenta, and yellow typically with each color contained in a separate chamber. The composition of the fluid was 5 to 10 weight percent 2-pyrrolidone, 6 to 8 weight percent 1,5 pentanediol, 6 to 8 weight percent trimethylolpropane (2-ethyl-2-hydroxymethyl-1,3-propanediol), and 0 to 2 weight percent butanol or isopropanol. The nozzles of the filled cartridge were then sealed with one of the tapes in the manner described the Examples 1–10. The fluid ejection cartridges with the tapes sealing the nozzles were exposed to 60° C. for two weeks in an accelerated aging tester to evaluate:

1. Fluid leakage

The fluid ejection cartridges with the tapes sealing the nozzles were inspected for fluid leakage after the accelerated aging test at 60° C. for two weeks. A simple scale was used to rank the risk of the fluid leakage. The ranking "low" denotes that the fluid was confined in the nozzle bores or around the nozzle rings under the tape. The ranking "medium" denotes that the fluid was observed to leak and encompass more than one nozzle under tape but does not cross the nozzle columns. The ranking "high" denotes that fluid leakage was observed and the fluid not only encompasses the nozzles but also crosses the nozzle columns.

2. Peel force

The 180-degree peel test was performed to remove the tape from the nozzle layer of a fluid ejection cartridge at a peel rate of 10 inches per minute. Results were taken as grams of peel force per millimeter width of the tape (g/mm).

3. Adhesive transfer

After the tape removal, the nozzle layer was observed for transferred tape adhesives. The symbol "yes" denotes that the tape adhesive was observed on the nozzle layer surface and the "no" denotes that no such adhesive transfer was observed.

TABLE 1

| Example No. | | Fluid leakage | Peel strength (g/mm) | Adhesive transfer |
|---|---|---|---|---|
| Example | 1 | medium | 5.24 | yes |
| | 2 | high | 22.8 | yes |
| | 3 | low | 35.4 | no |
| | 4 | low | 59.1 | no |

TABLE 1-continued

| Example No. | Fluid leakage | Peel strength (g/mm) | Adhesive transfer |
|---|---|---|---|
| 5 | low | 15.0 | no |
| 6 | medium | 1.58 | no |
| 7 | medium | 2.36 | no |
| 8 | low | n.t.* | no |
| 9 | low | n.t.* | no |
| 10 | low | n.t.* | no |

n.t. - not tested

Example 11

Thermoplastic polymer film tape 11 was prepared in the same manner as tape 3 except that the tape was crosslinked using a 5 mrad electron beam dose.

Example 12

Thermoplastic polymer film tape 12 was prepared in the same manner as tape 3 except that the tape was crosslinked using a 7.5 mrad electron beam dose.

Example 13

Thermoplastic polymer film tape 13 was prepared in the same manner as tape 3 except that the tape was crosslinked using a 10 mrad electron beam dose.

Example 14

Thermoplastic polymer film tape 14 was prepared in the same manner as tape 3 except that the tape was crosslinked using a 12.5 mrad electron beam dose.

Example 15

Thermoplastic polymer film tape 15 was prepared in the same manner as tape 3 except that the tape was crosslinked using a 15 mrad electron beam dose.

Example 16

Thermoplastic polymer film tape 16 was prepared in the same manner as tape 3 except that the tape was crosslinked using a 17.5 mrad electron beam dose.

Figure 8:
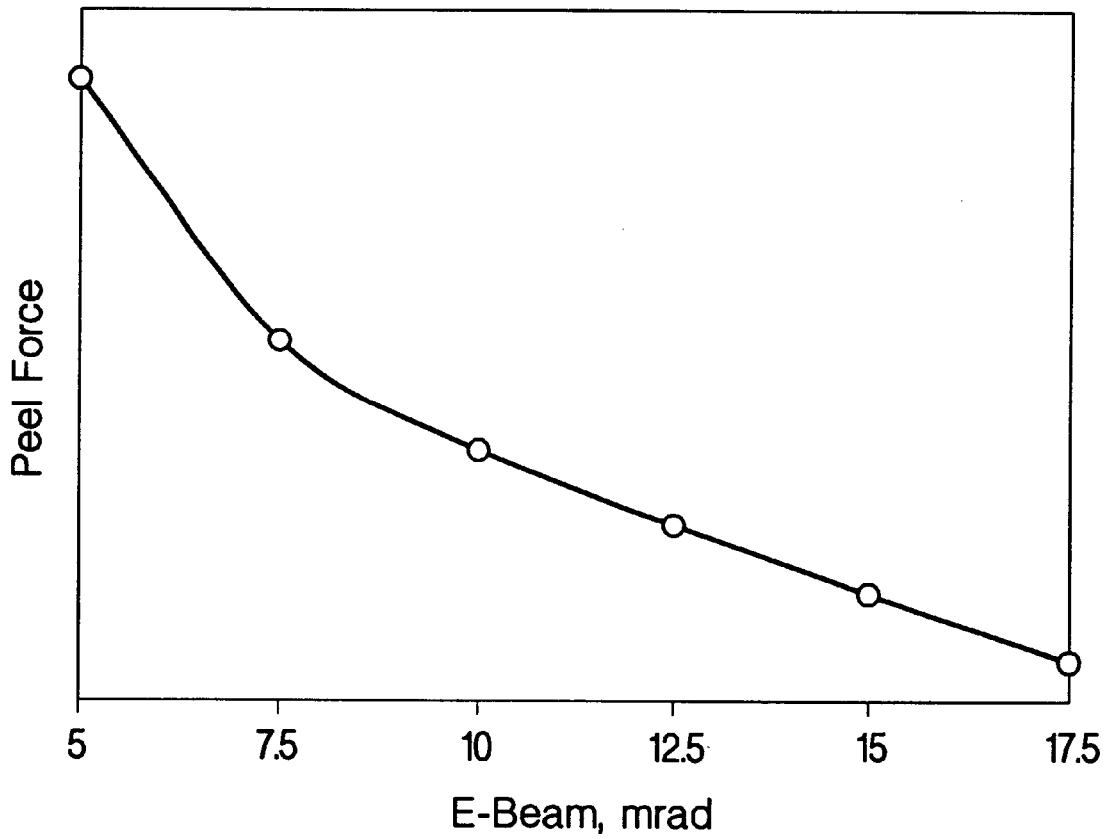
FIG. 8 is a graph of the peel strength of a tape as a function of electron beam dosage according to an alternate embodiment of this invention.

Tapes 11–16 were heated to about 120° C. and attached to the nozzle layer of a fluid ejection cartridge with a pressure of 45 psi. The fluid ejection cartridges with the tapes sealing the nozzles were exposed to 60° C. for two weeks in an accelerated aging tester and then peel tested using the process described above. A graph of the peel strength of the various tapes as a function of electron beam dosage is shown in FIG. 8. The change in peel strength as a function of electron beam dosage demonstrates the ability to further tune the adhesion force of the thermoplastic polymer film to the nozzle layer via crosslinking density.

The present invention advantageously uses a thermoplastic polymer film optimized for ink compatibility and also utilizes higher sealing temperatures and pressures to form a robust seal around the nozzles of a fluid ejection cartridge. The thermoplastic polymer film is preferably either a thermoplastic crystalline or semi-crystalline polymer or a thermoplastic elastomer. The thermoplastic polymer film has the advantages of being mechanically strong, resistant to a wider range of fluids than PSA's, contains little or no additives, and typically has lower water vapor transmission rates than PSA's. In addition, the thermoplastic polymer film conforms well around abrupt structural features on the fluid ejection device. The thermoplastic polymer film also provides the ability to tune the adhesion properties by using different sealing temperatures, pressures, and times, thus optimizing the sealing properties for different fluid ejection cartridges.

What is claimed is:

1. A fluid ejection cartridge, comprising:

a fluid ejector head having at least one nozzle;

a fluid reservoir containing an ejectable fluid fluidically coupled with at least one nozzle; and a tape comprising a thermoplastic polymer film having a thickness from about 5 to about 500 microns, and a melting temperature greater than 35° C. and a melt index in the range of from about 0.5 to about 50 grams per minute, said thermoplastic polymer film in contact with and releasably bonded to said at least one nozzle.

2. The fluid ejection cartridge of claim 1, wherein said tape further comprises a base film adhesively bonded to said thermoplastic polymer film.

3. The fluid ejection cartridge of claim 1, wherein said tape further comprises a moisture barrier film.

4. The fluid ejection cartridge of claim 1, wherein said tape further comprises an air barrier film.

5. The fluid ejection cartridge of claim 1, wherein said tape further comprises an electrostatically dissipating film.

6. The fluid ejection cartridge of claim 1, wherein said tape further comprises an electrostatically shielding film.

7. The fluid ejection cartridge of claim 1, wherein said thermoplastic polymer film contains less than from about 20 to about 30 weight percent low molecular weight additives.

8. The fluid ejection cartridge of claim 7, wherein said low molecular weight additives have molecular weights less than about 2000 grams per mole.

9. The fluid ejection cartridge of claim 1, wherein said ejector head further comprises a nozzle layer containing said at least one nozzle.

10. The fluid ejection cartridge of claim 9, wherein said nozzle layer further comprises a metal.

11. The fluid ejection cartridge of claim 10, wherein said metal is selected from the group consisting of nickel, gold, palladium, tantalum, rhodium, and combinations thereof.

12. The fluid ejection cartridge of claim 9, wherein said nozzle layer further comprises a polymer.

13. The fluid ejection cartridge of claim 12, wherein said polymer is selected from the group consisting of polyimide, polyester, epoxy, and combinations thereof.

14. The fluid ejection cartridge of claim 9, wherein said nozzle layer further comprises a glass.

15. The fluid ejection cartridge of claim 1, further comprising at least one electrical contact disposed on said fluid reservoir, wherein said thermoplastic polymer film is in contact with and releasably bonded to said at least one electrical contact.

16. The fluid ejection cartridge of claim 15, comprising at least one electrical trace disposed on said fluid reservoir and coupling said at least one electrical contact with said ejector head wherein said thermoplastic polymer film is in contact with and releasably bonded to said at least one electrical trace.

17. The fluid ejection cartridge of claim 1, wherein said tape further comprises:

a base film;

an electrostatically dissipating film coupled to said base film;

a moisture barrier film coupled to said electrostatically dissipating film; and an air barrier film coupled to said base film.

18. The fluid ejection cartridge of claim 1, wherein said thermoplastic polymer film comprises:

from about 60 to about 95 weight percent polyethylene, from about 0 to about 40 weight percent polyvinyl acetate, from about 0 to about 30 weight percent polymethacrylic acid.

19. A tape for sealing nozzles on a fluid ejection cartridge comprising a thermoplastic polymer film having a thickness from about 5 to about 500 microns, and a melting temperature greater than 35° C. and a melt index from about 0.5 to about 50 grams per minute.

20. The tape of claim 19, wherein said thermoplastic polymer film has a thickness from about 10 to about 100 microns, a melting temperature from about 70° C. to about 130° C. and a melt index from about 0.5 to about 5.0 grams per minute.

21. The tape of claim 19, wherein said thermoplastic polymer film is a semi-crystalline binary copolymer film.

22. The tape of claim 19, wherein said thermoplastic film is a semi-crystalline ternary copolymer film.

23. The tape of claim 22, wherein said semi-crystalline ternary copolymer film comprises:

from about 60 to about 95 weight percent polyethylene, from about 0 to about 40 weight percent polyvinyl acetate, from about 0 to about 30 weight percent polymethacrylic acid.

24. The tape of claim 19, wherein said thermoplastic polymer film is a polymer blend.

25. The tape of claim 19, further comprising a base film adhesively bonded to said thermoplastic polymer film.

26. The tape of claim 25, wherein said base film has a thickness from about 5 to about 500 microns.

27. The tape of claim 25, wherein said base film is selected from the group consisting of polyvinyl chloride, polyethylene, polyethylene naphthalate, polyamide, polyester, polyamide, polyarylates, polybutylene terepthalate, polypropylene, polyurethanes and mixtures thereof.

28. The tape of claim 19, wherein said thermoplastic polymer film is crosslinked.

29. The tape of claim 28, wherein said thermoplastic polymer film is electron beam crosslinked in the range of 0–30 mrad.

30. The tape of claim 28, wherein said thermoplastic polymer film is chemically crosslinked.

31. The tape of claim 28, wherein said thermoplastic polymer film is crosslinked using electromagnetic radiation.

32. The tape of claim 19, wherein said thermoplastic polymer film contains less than about 20 to about 30 weight percent low molecular weight additives.

33. The tape of claim 32, wherein said low molecular weight additives have molecular weights less than about 2000 grams per mole.

34. A method of releasably sealing the nozzles of a nozzle layer in a fluid ejection cartridge having a reservoir, the method comprising the steps of:

releasably capturing a tape comprising a thermoplastic polymer film having a thickness in the range of from about 5 to about 500 microns;

cutting said tape to a length sufficient to cover the nozzles;

positioning said tape over the nozzle layer;

heating said tape; and attaching said tape to the fluid ejection cartridge wherein a first portion of said tape is releasably bonded to the nozzle layer covering the nozzles and a second portion of said tape is releasably bonded to the reservoir.

35. The method of claim 34, wherein said attaching step further comprises the step of releasably bonding a third portion of said tape to an electrical contact disposed on said fluid ejection cartridge.

36. The method of claim 34, wherein said tape further comprises a base film adhesively bonded to said thermoplastic polymer film.

37. The method of claim 34, wherein said heating step further comprises heating said tape in a range of from about 10° C. to about 50° C. above the melting temperature of said thermoplastic polymer film.

38. The method of claim 34, wherein said heating step further comprises applying pressure in a range of from about 7 to about 100 psi.

39. The method of claim 34, wherein said heating step further comprises applying pressure in a range of from about 30 to about 60 psi.

40. The method of claim 34, further comprising the step of removing said tape at room temperature.

41. A fluid ejection cartridge comprising:

an ejector head having at least one nozzle;

a fluid reservoir containing an ejectable fluid fluidically coupled with at least one nozzle;

a tape having a thermoplastic polymer film in contact with and releasably bonded to said at least one nozzle and a base film adhesively bonded to said thermoplastic polymer film, wherein said thermoplastic polymer film has a thickness from about 25 to about 75 microns, and a melting temperature from about 70° C. to about 120° C. and a melt index from about 0.5 to about 1.0 grams per minute;

at least one electrical contact disposed on said fluid reservoir, wherein said thermoplastic polymer film is in contact with an releasably bonded to said at least one electrical contact.

42. A tape that seals nozzles on a fluid ejection cartridge comprising:

a crosslinked semi-crystalline ternary copolymer thermoplastic polymer film comprises:

from about 60 to about 95 weight percent polyethylene, from about 0 to about 40 weight percent polyvinyl acetate, from about 0 to about 30 weight percent polymethacrylic acid, wherein said crosslinked semi-crystalline ternary copolymer thermoplastic film has a thickness from about 25 to about 75 microns, a melting temperature from about 70° C. to about 120° C. and a melt index from about 0.5 to about 1.0 grams per minute; and a base film adhesively bonded to said crosslinked semi-crystalline ternary copolymer thermoplastic film.

* * * * *